US006837500B2

(12) United States Patent
van Egeraat

(10) Patent No.: US 6,837,500 B2
(45) Date of Patent: Jan. 4, 2005

(54) ROLLER SKATE FRAME ASSEMBLY

(75) Inventor: Hendrikus Adrianus van Egeraat, Örebro (SE)

(73) Assignee: PC-Vane Sportartikel GmbH, Bremerhaven (DE)

( * ) Notice: Subject to any disclaimer, the term of this patent is extended or adjusted under 35 U.S.C. 154(b) by 85 days.

(21) Appl. No.: 10/428,934

(22) Filed: May 5, 2003

(65) Prior Publication Data

US 2004/0222602 A1 Nov. 11, 2004

(51) Int. Cl.[7] ..... A63C 17/00
(52) U.S. Cl. ..... 280/11.27; 280/11.221
(58) Field of Search ..... 280/11.221, 11.14, 280/11.15, 11.19, 11.222, 11.224, 11.225, 11.227, 11.233, 11.25, 11.26, 11.27, 11.3, 11.34, 11.231

(56) References Cited

U.S. PATENT DOCUMENTS 5,271,633 A * 12/1993 Hill, Jr. ..... 280/11.221
5,961,129 A * 10/1999 Post et al. ..... 280/11.27
6,019,377 A * 2/2000 Chiu et al. ..... 280/11.19
6,142,490 A * 11/2000 Monroy et al. ..... 280/11.27
6,527,283 B1 * 3/2003 Bonaventure ..... 280/11.221
6,557,863 B2 * 5/2003 Chen ..... 280/11.221
6,592,130 B2 * 7/2003 Frigo et al. ..... 280/11.221
6,648,346 B2 * 11/2003 Borel ..... 280/11.3

* cited by examiner

*Primary Examiner*—Hau Phan
(74) *Attorney, Agent, or Firm*—Baker Botts L.L.P.

(57) ABSTRACT

A roller skate frame assembly includes a frame body with front and rear shoe-mounting plates that are formed with fastening holes, a pair of fastening units, and a bracket with front and rear mounting units, each of which has a first part secured to a shoe, and a second part formed with a fastening hole and secured to a respective one of the front and rear shoe-mounting plates through a respective one of the fastening units which extends through a pair of the fastening holes in the second part and the respective one of the front and rear shoe-mounting plates.

5 Claims, 6 Drawing Sheets

ROLLER SKATE FRAME ASSEMBLY

BACKGROUND OF THE INVENTION

1. Field of the Invention

This invention relates to a roller skate frame assembly, more particularly to a roller skate frame assembly with a shoe-mounting bracket.

2. Description of the Related Art

FIG. 1 illustrates a conventional roller skate frame 12 together with a plurality of wheels 13 and a shoe 11 for a roller skate. The roller skate frame 12 includes front and rear shoe-mounting plates 120 that are formed with a plurality of slots 121. The slots 121 are aligned in a longitudinal direction, and extend in a transverse direction relative to the longitudinal direction so as to permit mounting of the shoe 11 on the front and rear shoe-mounting plates 120 with the use of screws (not shown) and so as to permit position adjustment of the shoe 11 along the longitudinal direction and along the transverse direction.

The conventional roller skate frame 12 is relatively inconvenient to use since mounting of the shoe 11 on the roller skate frame 12 requires position adjustment of the shoe 11 relative to the roller skate frame 12 along the aforesaid longitudinal and transverse directions, which is time-consuming. This is especially important for a long distance or a marathon race contest, where a worn tire together with the roller skate frame 12 or a deformed roller skate frame 12 must be replaced as quickly as possible during the contest.

SUMMARY OF THE INVENTION

Therefore, the object of the present invention is to provide a roller skate frame assembly that is capable of overcoming the aforesaid drawbacks of the prior art.

According to the present invention, there is provided a roller skate frame assembly that comprises: an elongated frame body extending in a longitudinal direction and including a wheel-mounting plate with a top end, and front and rear shoe-mounting plates that extend from the top end of the wheel-mounting plate in a transverse direction relative to the wheel-mounting plate, and that are aligned in the longitudinal direction, each of the front and rear shoe-mounting plates being formed with a fastening hole; a pair of fastening units; and a bracket including front and rear mounting units, each of which includes a first part that extends in the longitudinal direction, and a second part that extends from the first part in the longitudinal direction. The first part is formed with a plurality of elongated slots that extend in the transverse direction and that are aligned in the longitudinal direction so as to permit mounting of the shoe on the first part and so as to permit position adjustment of the shoe on the first part along the longitudinal direction and along the transverse direction. The second part of each of the front and rear mounting units is formed with a fastening hole, and is detachably secured to a respective one of the front and rear shoe-mounting plates through a respective one of the fastening units in such a manner that the second part is seated on the respective one of the front and rear shoe-mounting plates, that the fastening hole in the second part is registered with the fastening hole in the respective one of the front and rear shoe-mounting plates, and that the respective one of the fastening units extends through a pair of the fastening holes in the second part and the respective one of the front and rear shoe-mounting plates.

BRIEF DESCRIPTION OF THE DRAWINGS

In drawings which illustrate embodiments of the invention.

DETAILED DESCRIPTION OF THE PREFERRED EMBODIMENTS

Figure 1:
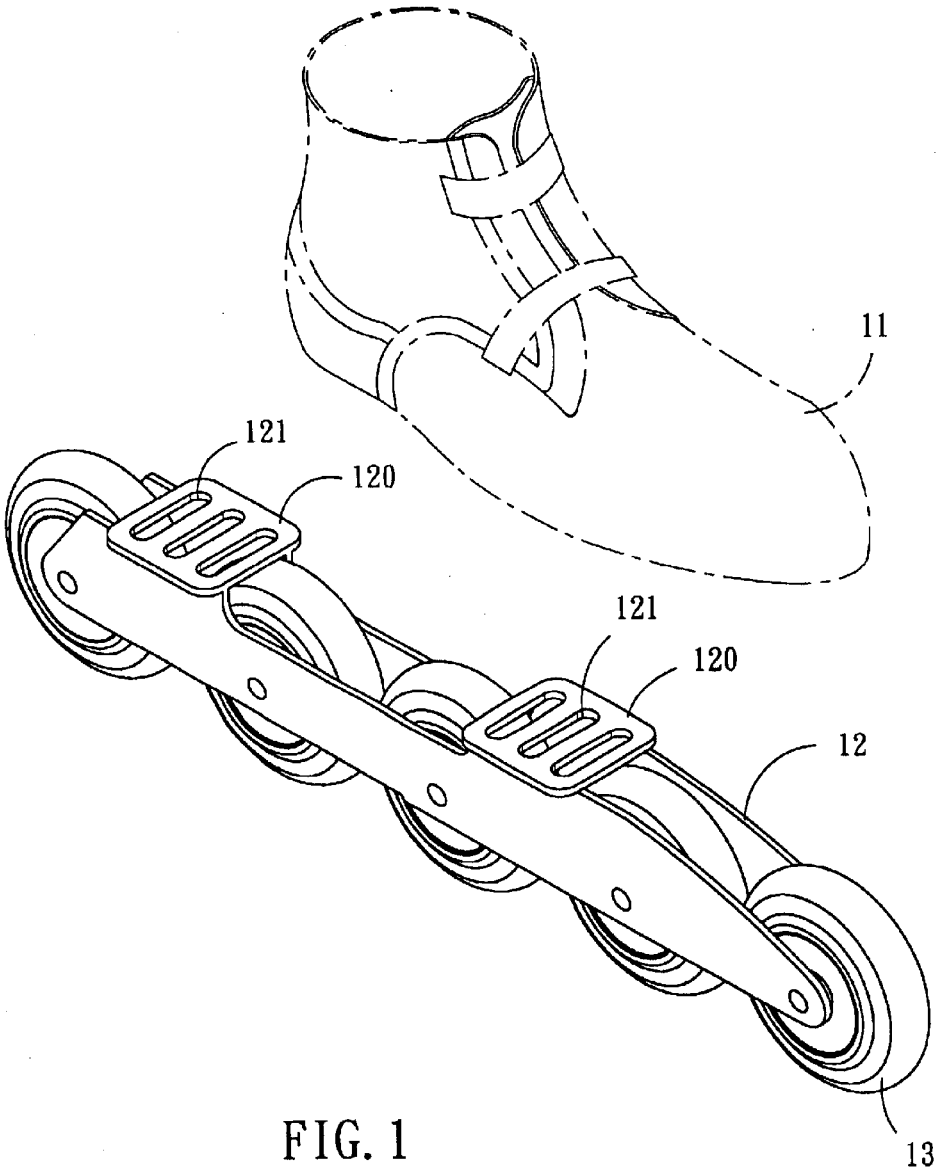
FIG. 1 PRIOR ART
FIG. 1 is a perspective view of a conventional roller skate frame with a shoe for a roller skate.

For the sake of brevity, like elements are denoted by the same reference numerals throughout the disclosure.

Figure 2:
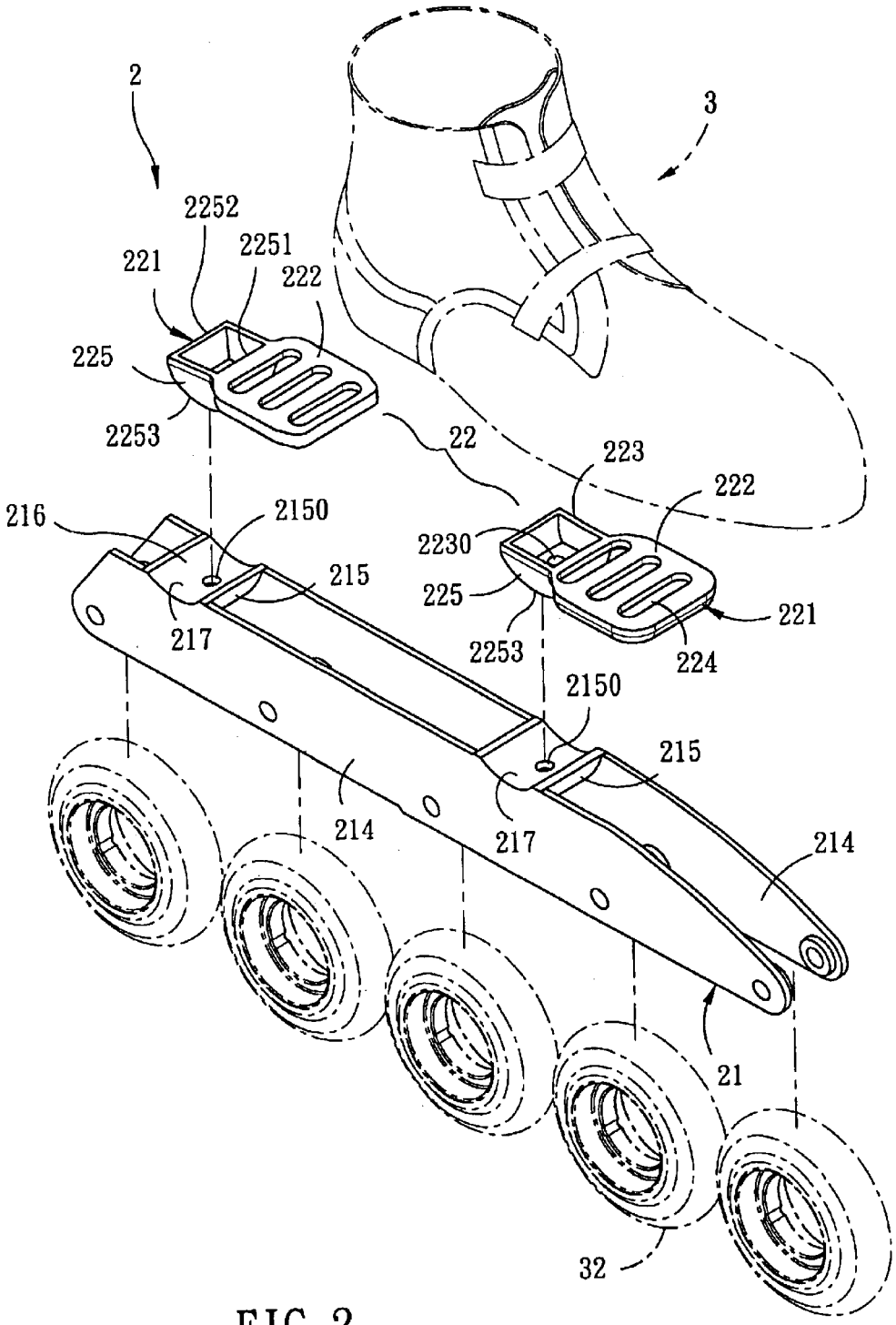
FIG. 2 is an exploded perspective view of a first preferred embodiment of a roller skate frame assembly according to this invention, shown together with wheels and a shoe for a roller skate.
Figure 3:
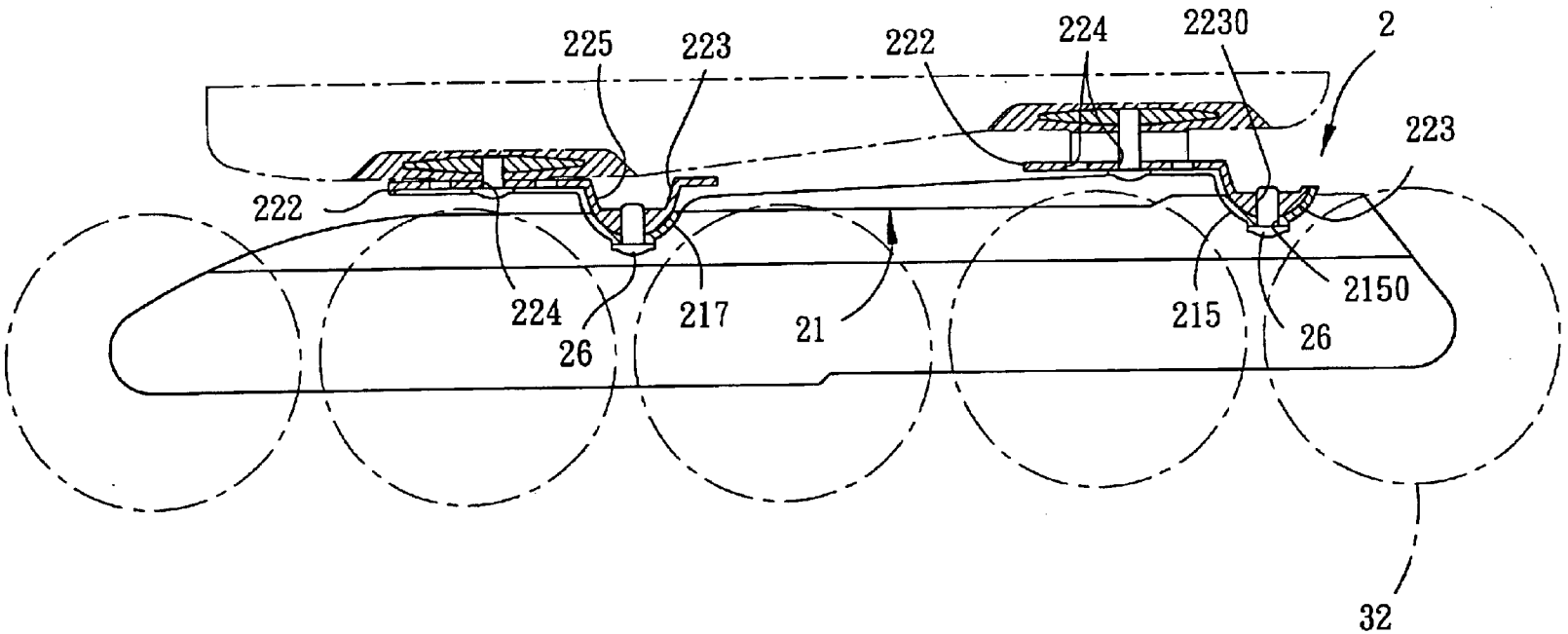
FIG. 3 is schematic sectional view of the roller skate frame assembly of FIG. 2, with the shoe and the wheels in an assembled state.

FIGS. 2 and 3 illustrate the first preferred embodiment of a roller skate frame assembly 2 according to this invention, shown together with a shoe 3 and a plurality of wheels 32 (five wheels 32 are provided for this embodiment) for a roller skate. The roller skate frame assembly 2 includes: an elongated frame body 21 extending in a longitudinal direction and including a pair of parallel wheel-mounting plates 214 with top ends, and front and rear shoe-mounting plates 215 that extend between the top ends of the wheel-mounting plates 214 in a transverse direction relative to the wheel-mounting plates 214, and that are aligned in the longitudinal direction, each of the front and rear shoe-mounting plates 215 being formed with a fastening hole 2150; a pair of fastening units 26; and a bracket 22 including front and rear mounting units 221, each of which includes a first part 222 that extends in the longitudinal direction, and a second part 223 that extends from the first part 221 in the longitudinal direction. The first part 221 is formed with a plurality of elongated slots 224 that extend in the transverse direction and that are aligned in the longitudinal direction so as to permit mounting of the shoe 3 on the first part 222 and so as to permit position adjustment of the shoe 3 on the first part 222 along the longitudinal direction and along the transverse direction. The second part 223 of each of the front and rear mounting units 22 is formed with a fastening hole 2230, and is detachably secured to a respective one of the front and rear shoe-mounting plates 215 through a respective one of the fastening units 26 in such a manner that the second part 223 is seated on the respective one of the front and rear shoe-mounting plates 215, that the fastening hole 2230 in the second part 223 is registered with the fastening hole 2150 in the respective one of the front and rear shoe-mounting plates 215, and that the respective one of the fastening units 26 extends through a pair of the fastening holes 2230, 2150 in the second part 223 and the respective one of the front and rear shoe-mounting plates 215.

Each of the front and rear shoe-mounting plates 215 is curved, and has a curved inner face 216 that defines a recess 217. The second part 223 of each of the front and rear mounting units 221 has a curved wall 225 that is received in the recess 217 and that conforms to the inner face 216 of the respective one of the front and rear shoe-mounting plates 215 (see FIG. 3). The curved wall 225 has opposite front and rear ends 2251, 2252 disposed above the top ends of the wheel-mounting plates 214 and opposite to each other in the longitudinal direction, and a bottom 2253 disposed below the top ends of the wheel-mounting plates 214 (see FIG. 2). The fastening hole 2230 in the second part 223 is formed at the bottom 2253 of the curved wall 225. The first part 222 extends from the front end 2251 of the curved wall 225 of the second part 223.

Figure 4:
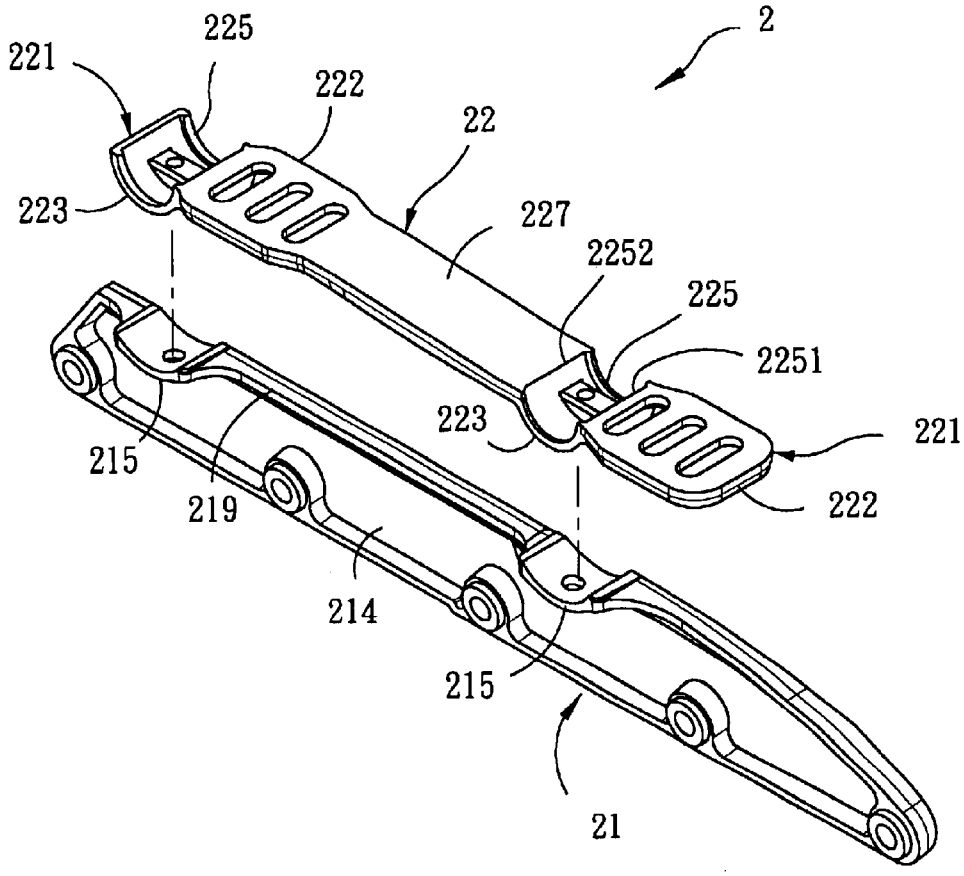
FIG. 4 is an exploded perspective view of a second preferred embodiment of the roller skate frame assembly according to this invention.

FIG. 4 illustrates the second preferred embodiment of the roller skate frame assembly 2 according to this invention. The roller skate frame assembly 2 is similar to the previous embodiment, except that the bracket further includes a middle plate 227 which is disposed between and which interconnects the front and rear mounting units 221, and that the frame body 21 has a substantially inverted L-shaped configuration with a single wheel-mounting plate 214. In this embodiment, the middle plate 227 interconnects the first part 222 of the rear mounting unit 221 and the rear end 2252 of the curved wall 225 of the second part 223 of the front mounting unit 221. The frame body 21 further includes a middle plate 219 that interconnects the front and rear shoe-mounting plates 215. The wheel-mounting plate 214, the middle plate 219 and the front and rear shoe-mounting plates 215 are integrally formed in a conventional manner, such as by molding, welding, or forging techniques.

Figure 5:
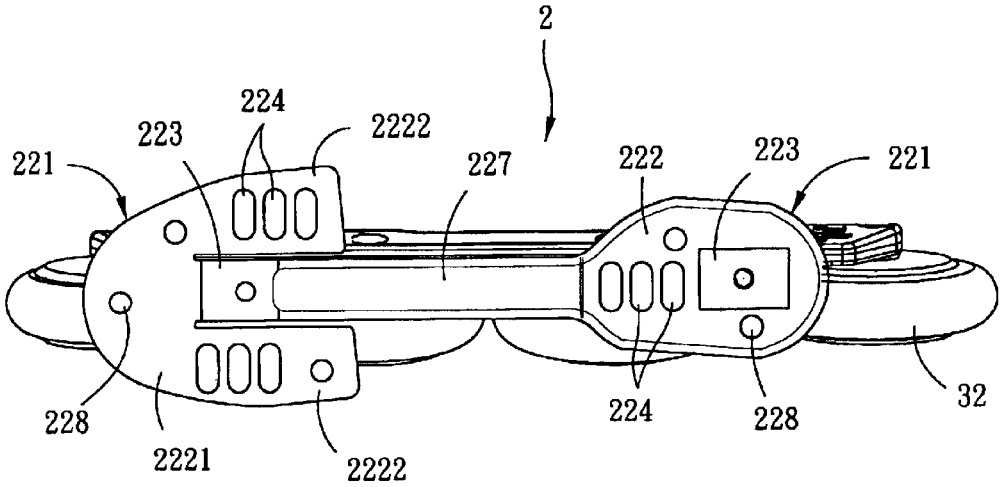
FIG. 5 is a top view of a third preferred embodiment of the roller skate frame assembly according to this invention, shown together with the wheels.
Figure 6:
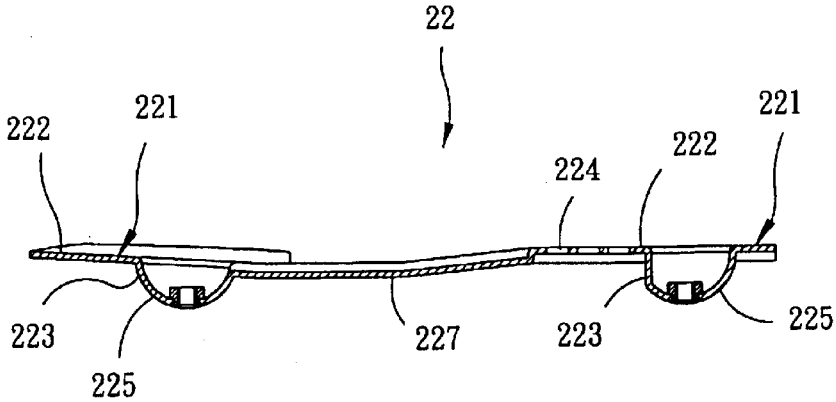
FIG. 6 is a sectional view of a bracket of the roller skate frame assembly of FIG. 5.
Figure 7:
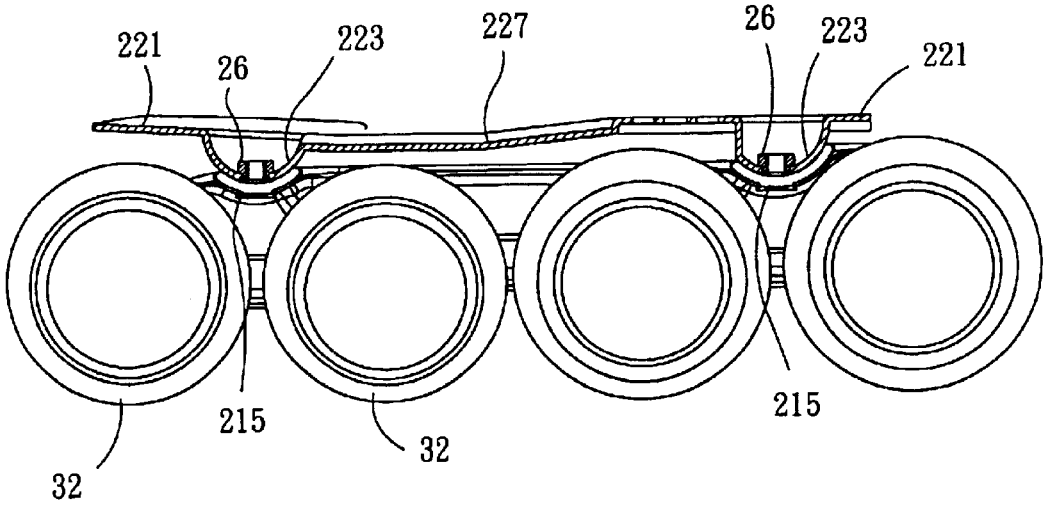
FIG. 7 is a sectional view of the roller skate frame assembly of FIG. 5.

FIGS. 5 to 7 illustrate a third preferred embodiment of the roller skate frame assembly 2 according to this invention. Unlike the previous embodiments, the second part 223 of the rear mounting unit 221 of this embodiment extends rearwardly from the first part 222 in the longitudinal direction, and the first part 222 of the front mounting unit 221 is in the form of a U-shaped plate that has a bight portion 2221 extending frontwardly from the second part 223 of the front mounting unit 221 in the longitudinal direction, and opposite left and right wings 2222 extending rearwardly from two opposite ends of the bight portion 2221 in the longitudinal direction to surround two opposite sides of the second part 223 of the front mounting unit 221. Each of the first part 222 of the rear mounting unit 221 and the left and right wings 2222 of the first part 222 of the front mounting unit 221 is formed with a plurality of elongated slots 224 extending in the transverse direction and aligned in the longitudinal direction so as to permit mounting of the shoe 3 on the first parts 222 of the front and rear mounting units 221 and so as to permit position adjustment of the shoe 3 on the first parts 222 along the longitudinal direction and along the transverse direction. The first parts 222 of the front and rear mounting units 221 are further formed with a plurality of screw holes 228 for extension of screw means (not shown) therethrough so as to firmly secure the frame body 21 to a shoe plate on the shoe 3 (not shown). Preferably, four of the wheels 32 are provided on the frame body 21 of this embodiment.

In use, the first parts 222 of the front and rear mounting units 221 of the bracket 22 are first fixed to the shoe 3 at a desired position (i.e., a center position relative to the gravity), followed by securing the second parts 223 of the front and rear mounting units 221 to the front and rear shoe-mounting plates 215. Since the first parts 222 of the front and rear mounting units 221 of the bracket 22 have been positioned on the shoe 3, position adjustment of the frame body 21 relative to the shoe 3 is obviated during replacement of the frame body 21. This is particularly important since the time required for replacement of the frame body 21 during a race contest can be reduced. In addition, the mechanical strength of the frame body 21 is enhanced by connecting with the bracket 22.

With the invention thus explained, it is apparent that various modifications and variations can be made without departing from the spirit of the present invention.

I claim:

1. A roller skate frame assembly adapted to be connected to a shoe, said roller skate frame assembly comprising:

an elongated frame body extending in a longitudinal direction and including a wheel-mounting plate with a top end, and front and rear shoe-mounting plates that extend from said top end of said wheel-mounting plate in a transverse direction relative to said wheel-mounting plate, and that are aligned in said longitudinal direction, each of said front and rear shoe-mounting plates being formed with a fastening hole;

a pair of fastening units; and a bracket including front and rear mounting units, each of which includes a first part that extends in said longitudinal direction, and a second part that extends from said first part in said longitudinal direction, said first part being formed with a plurality of elongated slots that extend in said transverse direction and that are aligned in said longitudinal direction so as to permit mounting of the shoe on said first part and so as to permit position adjustment of the shoe on said first part along said longitudinal direction and along said transverse direction, said second part of each of said front and rear mounting units being formed with a fastening hole and being detachably secured to a respective one of said front and rear shoe-mounting plates through a respective one of said fastening units in such a manner that said second part is seated on the respective one of said front and rear shoe-mounting plates, that said fastening hole in said second part is registered with said fastening hole in the respective one of said front and rear shoe-mounting plates, and that the respective one of said fastening units extends through a pair of said fastening holes in said second part and the respective one of said front and rear shoe-mounting plates.

2. The roller skate frame assembly of claim 1, wherein each of said front and rear shoe-mounting plates is curved, and has a curved inner face that defines a recess, said second part of each of said front and rear mounting units having a curved wall that is received in said recess and that conforms to said inner face of the respective one of said front and rear shoe-mounting plates.

3. The roller skate frame assembly of claim 2, wherein said curved wall has opposite front and rear ends disposed above said top end of said wheel-mounting plate and opposite to each other in said longitudinal direction, and a bottom disposed below said top end of said wheel-mounting plate, said fastening hole in said second part being formed at said bottom of said curved wall, said first part extending from said front end of said curved wall of said second part, said bracket further including a middle plate that is disposed between said front and rear mounting units and that interconnects said first part of said rear mounting unit and said rear end of said curved wall of said second part of said front mounting unit.

4. A roller skate frame assembly adapted to be connected to a shoe, said roller skate frame assembly comprising:

an elongated frame body extending in a longitudinal direction and including a wheel-mounting plate with a top end, and front and rear shoe-mounting plates that extend from said top end of said wheel-mounting plate in a transverse direction relative to said wheel-mounting plate, and that are aligned in said longitudinal direction, each of said front and rear shoe-mounting plates being formed with a fastening hole;

a pair of fastening units; and a bracket including front and rear mounting units, each of which includes first and second parts, said second part of said rear mounting unit extending rearwardly from said first part in said longitudinal direction, said first part of said front mounting unit being in the form of a U-shaped plate that has a bight portion extending frontwardly from said second part of said front mounting unit in said longitudinal direction, and opposite left and right wings extending rearwardly from two opposite ends of said bight portion in said longitudinal direction to surround two opposite sides of said second part of said front mounting unit, each of said first part of said rear mounting unit and said left and right wings of said first part of said front mounting unit being formed with a plurality of elongated slots extending in said transverse direction and aligned in said longitudinal direction so as to permit mounting of the shoe on said first parts of said front and rear mounting units and so as to permit position adjustment of the shoe on said first parts along said longitudinal direction and along said transverse direction, said second part of each of said front and rear mounting units being formed with a fastening hole and being detachably secured to a respective one of said front and rear shoe-mounting plates through a respective one of said fastening units in such a manner that said second part is seated on the respective one of said front and rear shoe-mounting plates, that said fastening hole in said second part is registered with said fastening hole in the respective one of said front and rear shoe-mounting plates, and that the respective one of said fastening units extends through a pair of said fastening holes in said second part and the respective one of said front and rear shoe-mounting plates.

5. The roller skate frame assembly of claim 4, wherein each of said left and right wings is further formed with a plurality of locking holes.

* * * * *